US006065692A

United States Patent [19]

Brinn, Jr.

[11] Patent Number: 6,065,692

[45] Date of Patent: May 23, 2000

[54] VALVE SEAT SUBASSEMBLY FOR FUEL INJECTOR

[75] Inventor: Benjamin F. Brinn, Jr., Williamsburg, Va.

[73] Assignee: Siemens Automotive Corporation, Auburn Hills, Mich.

[21] Appl. No.: 09/329,645

[22] Filed: Jun. 9, 1999

[51] Int. Cl.[7] ..... B05B 1/34; F02M 61/00

[52] U.S. Cl. ..... 239/533.12; 239/463; 239/533.2; 239/533.3; 239/533.11; 239/585.1; 239/585.4

[58] Field of Search ..... 239/533.2, 533.3, 239/533.8, 533.9, 533.11, 533.12, 463, 585.1, 585.4, 585.5

[56] References Cited

U.S. PATENT DOCUMENTS 4,967,959 11/1990 Wieczorek ..... 239/533.11 X
5,314,122 5/1994 Winter ..... 239/585.1
5,678,767 10/1997 Rahbar ..... 239/533.2
6,003,791 12/1999 Reiter ..... 239/585.5 X

*Primary Examiner*—Andres Kashnikow
*Assistant Examiner*—Robin O. Evans

[57] ABSTRACT

A solenoid actuated fuel injector includes a valve body having a longitudinal axis. A valve seat subassembly is mounted in one end of the valve body. The valve seat subassembly includes a valve seat having a seating surface and a circumferential sealing surface surrounding the seating surface. The valve seat subassembly also includes a lower needle guide and swirl disk laser welded to the valve seat. The subassembly includes a radially extending flange that axially positions the subassembly in the nose of the injector and eliminates the tolerances associated with the stack up height of conventional valve seat subassembly components.

4 Claims, 4 Drawing Sheets

A
34
36
32
10
56
12
54
42
16
14
38
50
44
20
22
24

24
50
44
58
60
62

VALVE SEAT SUBASSEMBLY FOR FUEL INJECTOR

FIELD OF THE INVENTION

This invention relates to needle type solenoid operated fuel injectors for controlling the injection of fuel into an internal combustion engine and more particularly to a valve seat subassembly and method of assembling the valve seat subassembly.

BACKGROUND OF THE INVENTION

During fuel injector assembly, it is known to locate a valve seat subassembly on a machined shoulder in the nose of the fuel injector valve body. The axial shoulder dimension is used to locate the valve seat subassembly and therefore determines armature position.

During assembly of the valve seat subassembly into the nose of the valve body, the seat subassembly, including a valve seat, swirl disk and lower needle guide, is located or stacked up against the machined shoulder of the valve body. The nose of the valve body is crimped to hold the seat subassembly. An alignment pin on a fixture is used to align the seat subassembly components and valve body. Resistance welding is used to weld the seat subassembly and valve body together.

In this arrangement, the stack up height of the lower needle guide, swirl disk and valve seat, together with the depth of the pocket adjacent the machined shoulder in the nose of the injector valve body is critical. Crimping the valve body nose can cause misalignment of the valve seat components relative to each other and relative to the valve body. Also, the use of resistance welding close to the center holes in the lower needle guide, swirl disk and valve seat distorts the valve seat subassembly.

SUMMARY OF THE INVENTION

The present invention provides a valve seat subassembly and method of assembling the valve seat subassembly and assembling the valve seat assembly into a fuel injector valve body with improved accuracy of alignment and that reduces axial tolerance sensitivity of the seat subassembly.

The present invention further provides a valve seat subassembly and method of assembling the valve seat subassembly and assembling the valve seat subassembly into the fuel injector valve body using laser welding techniques avoiding the heat distortion associated with resistance welding.

According to the invention, a solenoid actuated fuel injector which includes a valve body having a longitudinal axis, has a valve seat subassembly mounted in one end of the valve body. The valve seat subassembly includes a valve seat having a circular periphery and having first and second sides. The first side has a seating surface and a circumferential sealing surface surrounding the seating surface. The sealing and seating surfaces face the interior of the valve body. A fuel outlet opening is centered in the seating surface centered on the longitudinal axis and in communication with means for conducting pressurized fuel into the valve body against the seating surface. The second side has a radially extending flange which engages the nose of the fuel injector, is laser welded thereto and determines the axial positioning of the valve seat subassembly in the fuel injector.

The valve seat subassembly also includes a lower needle guide having a tube portion, for guiding an injector needle, and a flange portion extending from an end of the tube portion. The flange portion has a circular periphery which may be smaller than the circular periphery of the valve seat and a plurality of annularly disposed fuel flow apertures. A swirl disk including a plurality of flow passages corresponding with the apertures in the lower needle guide flange is laser welded between the valve seat sealing surface and the lower needle guide flange. The circular periphery of the swirl disk may be smaller than the circular periphery of the valve seat so that upon laser welding the subassembly components together, the weld flash does not extend beyond the periphery of the valve seat.

Upon assembly of the injector a needle having an end is moveable between a seated position; wherein the end is urged against the seating surface to close the outlet opening against fuel flow, and an open position; wherein the end is spaced from the seating surface to allow fuel flow through the outlet opening. Biasing means in the valve body is provided for biasing the needle toward the seated position.

A method of assembling the valve seat subassembly includes:

- providing a fixture having an axially extending alignment pin and at least one guide pin radially spaced from said alignment pin and extending parallel thereto;
- stacking in order the lower guide, tube portion down; the swirl disk; and the valve seat, sealing surface down; on the axial alignment pin;
- aligning the fuel flow apertures and fuel flow passages on the guide pin;
- applying a clamp force to the stacked lower guide, swirl disk and valve seat; and
- laser welding together, around and adjacent respective peripheral edges, the stacked lower guide, swirl disk and valve seat.

These and other features and advantages of the invention will be more fully understood from the following detailed description of the invention taken together with the accompanying drawings.

DETAILED DESCRIPTION OF THE INVENTION

Figure 1:
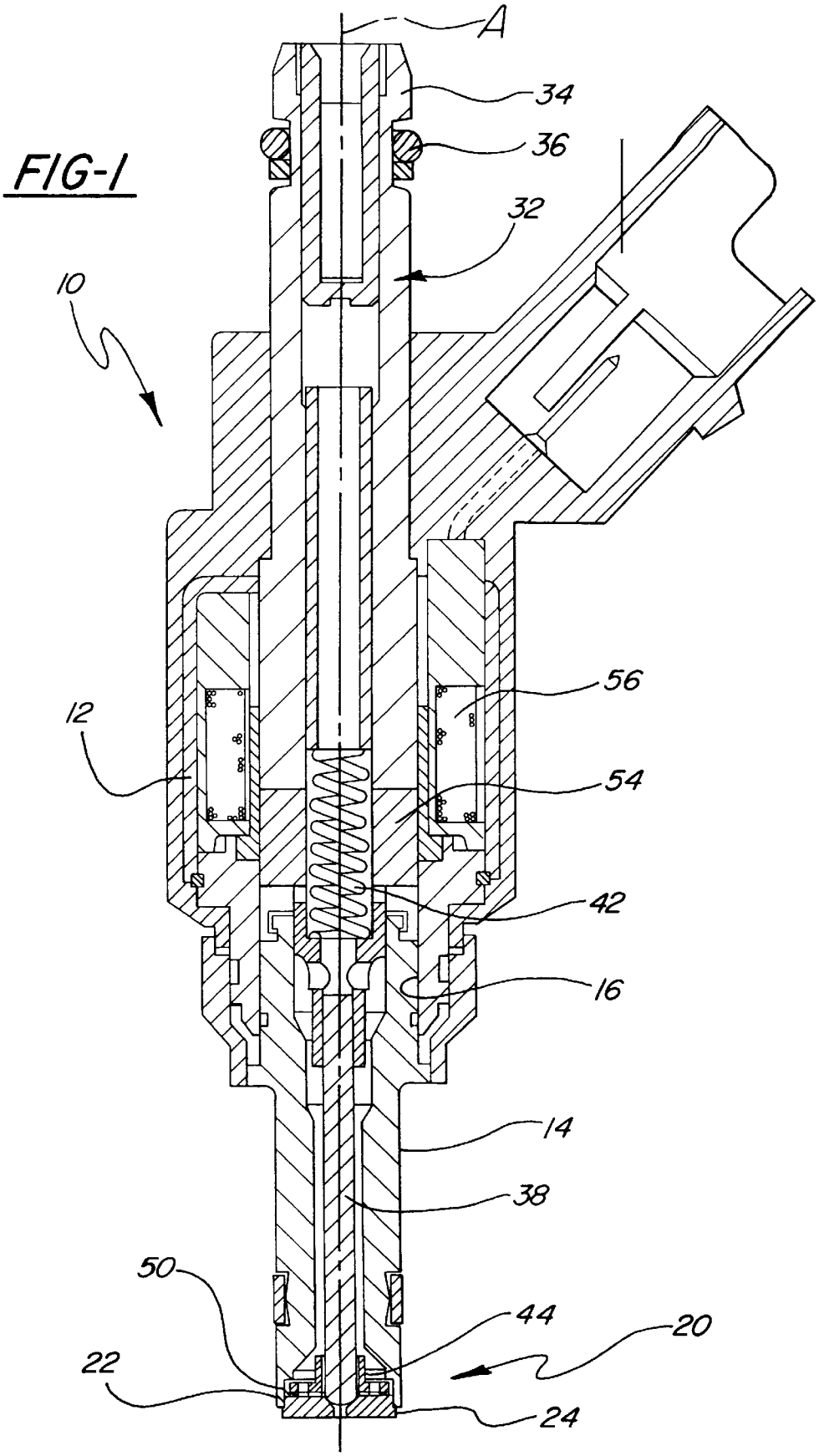
FIG. 1 is a sectional view of a solenoid actuated fuel injector constructed in accordance with the present invention.
Figure 2:
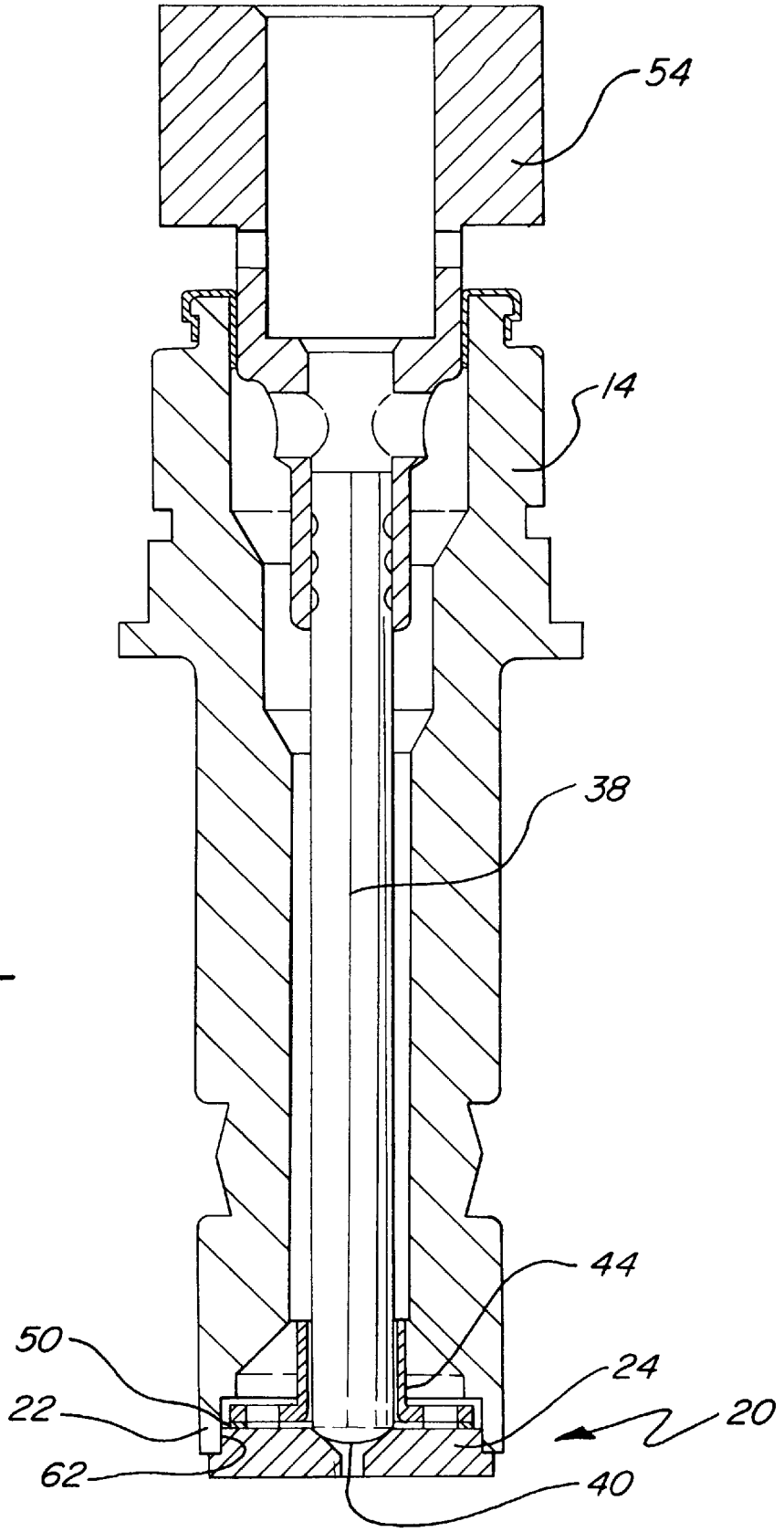
FIG. 2 is a sectional view of a valve body assembly of the fuel injector of FIG. 1 illustrating a valve seat subassembly mounted at one end of the valve body.
Figure 3:
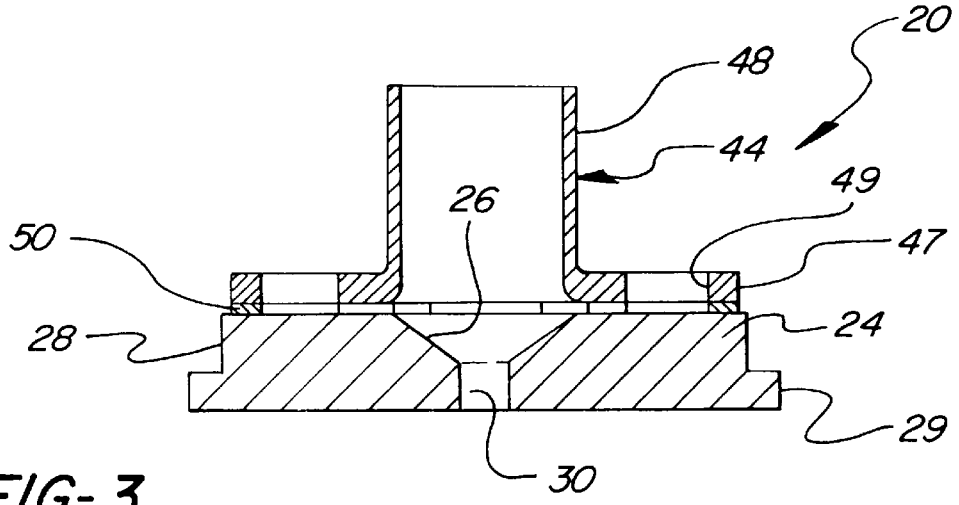
FIG. 3 is an enlarged sectional view of the valve seat subassembly illustrating the assembly of a valve seat, swirl disk and lower needle guide.
Figure 4:
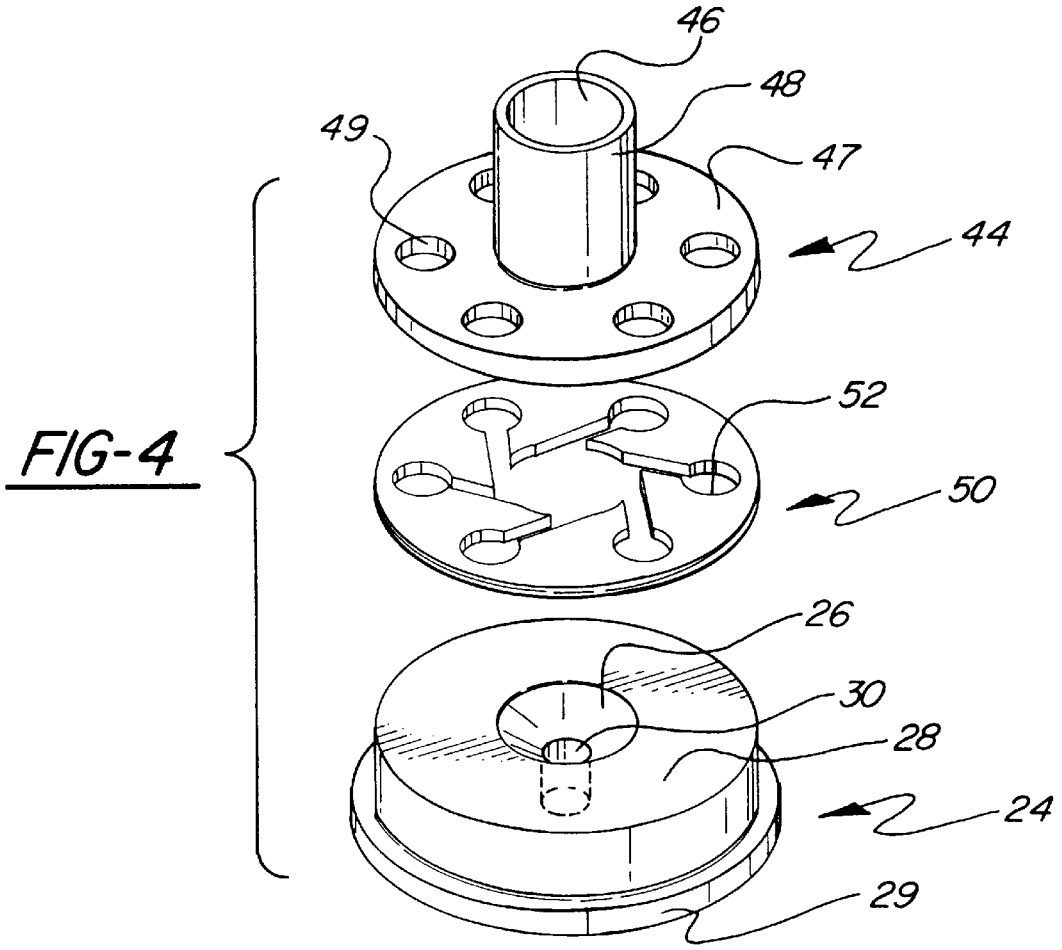
FIG. 4 is an exploded perspective view of the valve seat subassembly illustrating the valve seat having sealing and seating surfaces and a fuel outlet opening, the lower guide having a tubular bore and annular apertures and a swirl disk having a plurality of flow passages.

Referring now to the drawings in detail, numeral 10 generally indicates a solenoid actuated fuel injector of the top feed type for use with an internal combustion engine. The fuel injector 10 includes a housing 12 having a longitudinal axis A and a valve body 14 fixed to the housing. The valve body 14 has a circumferential sidewall 16 coaxial with the longitudinal axis A that laterally bounds the interior of the valve body 14.

A valve seat subassembly 20 mounted on one end 22 of the valve body 14 includes a valve seat 24 having a seating surface 26 and a sealing surface 27 surrounding the seating surface and a peripheral sidewall 28 having a flanged end 29. As is hereinafter more fully described, the flanged end 29 allows the valve seat subassembly 20 to be mounted in the end 22 of the fuel injector 10 and provide an accurate, consistent axial dimensional relationship of the valve seat relative to the valve body 14 avoiding the dimensional tolerances associated with conventional stacking of subassembly components in the end of the injector.

Seating and sealing surfaces 26, 28 face the interior of the valve body 14. The seating surface 26 is of a frustoconical or concave shape and includes a fuel outlet opening 30 centered on the axis A and is in communication with an inlet connector or fuel tube 32 for conducting pressurized fuel into the valve body 14 against the seating surface 26.

Fuel tube 32 includes a mounting end 34 that mounts the injector in a fuel rail (not shown) as is known. An O-ring 36 is used to seal the mounting end 34 in the fuel rail.

An elongated needle 38 having an end 40, of an arcuate or tapered shape, is disposed along the axis A and movable between a seated position, wherein the end is urged against the seating surface 26 to close the outlet opening against fuel flow, and an open position, wherein the end is spaced from the seating surface to allow fuel flow through the outlet opening 30. A spring 42 is provided in valve body 14 for biasing the end 40 toward the seated position.

The valve seat subassembly 20 also includes a lower needle guide 44 having an axially disposed tubular bore 46 for guiding the needle 38. In the illustrated embodiment, lower needle guide 44 includes a flange portion 47 and a tube portion 48 which includes the tubular bore 46. The flange portion 47 has a circular periphery smaller than the circular periphery of the valve seat 24 whereby the periphery of the flange can be laser welded to the valve seat without weld buildup extending beyond the periphery of the valve seat.

The flange portion 47 includes a plurality of annularly disposed fuel flow apertures 49 for communicating fuel through the lower needle guide 44.

Valve seat subassembly 20 also includes a swirl disk 50 including a plurality of flow passages corresponding with the apertures in the lower needle guide flange for communicating fuel toward fuel outlet opening 30. The diameter of the swirl disk 50, like that of the flange 47 is less than that of the valve seat 24 and the swirl disk 50 is laser welded between the valve seat sealing surface 27 and the lower needle guide flange 47.

The valve seat subassembly 20 which includes the valve seat 24, lower guide 44 and swirl disk 50 has its components laser welded together after precision alignment as hereinafter more fully described.

An armature 54 connected to needle 38 is axially movable in the valve body 14. A solenoid coil 56 is operable to draw the armature 54 away from the valve seat subassembly 20, thereby moving the needle end 40 off the seating surface 26, and allowing fuel to pass through the fuel outlet opening 30.

Figure 5:
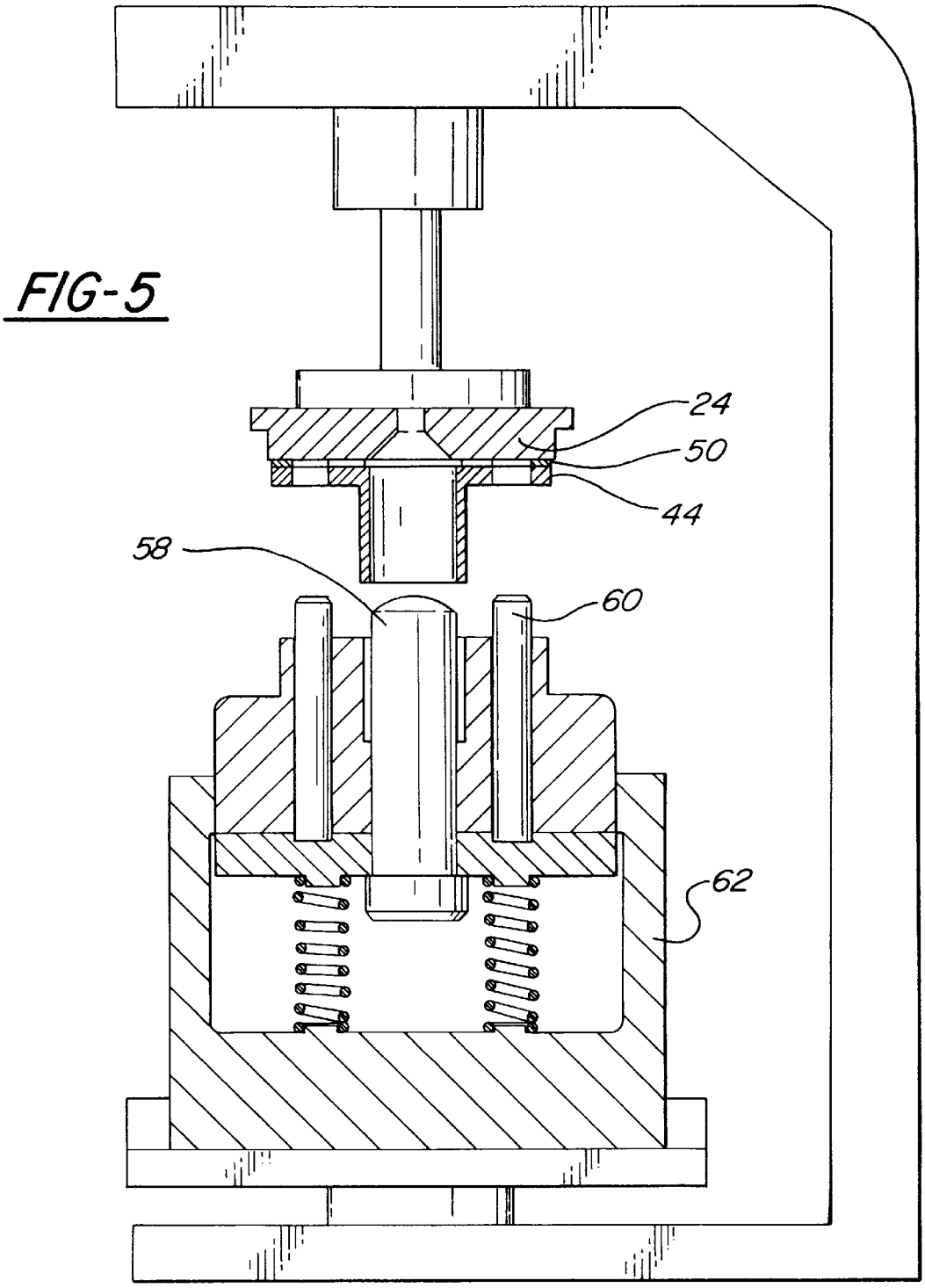
FIG. 5 is a sectional elevational view of a weld fixture and the valve seat subassembly.

Referring to FIG. 5, the valve seat subassembly 20 is constructed as follows. A fixture 62 is provided having an axially extending alignment pin 58 and at least one guide pin 60 radially spaced from the alignment pin and extending parallel thereto. Lower guide 44, tube portion down; swirl disk 50; and valve seat 24, sealing surface down; are then stacked in that order on the axial alignment pin 58. The fuel flow apertures and fuel flow passages are rotationally aligned on the guide pin 60. A clamp force is applied to the stacked lower guide 44, swirl disk 50 and valve seat 24. The stacked components are laser welded around respective peripheral edges. Laser welding the components of subassembly 20 together maintains the flatness of the swirl disk 50 and the tight sandwich configuration of the valve seat subassembly.

To assemble the valve seat subassembly 20 into the valve body 14, the valve body is assembled over a precision alignment pin fixture as is known. The assembled valve seat subassembly 20 is then installed over the small diameter of the precision alignment pin and the valve seat flanged end 29 rests on the end 22 of the valve body 14. A light clamping load is applied and the subassembly 20 is laser welded around the flanged end 29 of the valve seat 24 to the valve body 14. This assembly method eliminates locating the seat subassembly on a machined shoulder in the nose of the valve body.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A valve seat subassembly for an internal combustion engine fuel injector, the subassembly comprising:

a valve seat having a circular periphery and having first and second sides;

said first side having a seating surface and a surrounding sealing surface;

said seating surface including a fuel outlet opening centered therein;

said second side having a radially extending flange;

a lower needle guide having a tube portion for guiding an injector needle and also a flange portion extending from an end of said tube portion;

said flange portion having a plurality of annularly disposed fuel flow apertures; and a swirl disk including a peripheral edge and a plurality of flow passages corresponding with said apertures in said lower needle guide flange;

said swirl disk being laser welded around its peripheral edge between said valve seat sealing surface and said lower needle guide flange.

2. A valve seat subassembly as in claim 1 wherein said flange portion has a circular periphery smaller than the circular periphery of said valve seat.

3. A valve seat subassembly as in claim 1 wherein said swirl disk peripheral edge has a circular periphery smaller than the circular periphery of said valve seat.

4. A valve seat subassembly as in claim 1 in combination with a fuel injector including a valve body having a longitudinal axis and an end for receiving said valve seat subassembly;

said valve seat flanged end resting on said end of said valve body and being laser welded thereto.

* * * * *